United States Patent [19]

Pirner et al.

[11] 4,346,359

[45] Aug. 24, 1982

[54] RELAY

[75] Inventors: Paul Pirner, Altdorf; Alois Muehling, Pleinfeld, both of Fed. Rep. of Germany

[73] Assignee: Siemens Aktiengesellschaft, Berlin and Munich, Fed. Rep. of Germany

[21] Appl. No.: 226,718

[22] Filed: Jan. 21, 1981

[30] Foreign Application Priority Data

Jan. 21, 1980 [DE] Fed. Rep. of Germany ..... 3002079

[51] Int. Cl.[3] ..... H01H 45/02

[52] U.S. Cl. ..... 335/202; 335/128; 335/203

[58] Field of Search ..... 335/202, 203, 128, 131, 335/135, 133

[56] References Cited

U.S. PATENT DOCUMENTS

| | | | |
|---|---|---|---|
| 3,474,367 | 10/1969 | Zupa . | |
| 3,548,139 | 12/1970 | Mendon et al. | 335/135 |
| 3,824,511 | 7/1974 | Aidn et al. | 335/133 |
| 4,193,052 | 3/1980 | Hayden | 335/128 |

FOREIGN PATENT DOCUMENTS

| | | |
|---|---|---|
| 644964 | 7/1964 | Belgium . |
| 1267757 | 5/1968 | Fed. Rep. of Germany . |
| 1051255 | 1/1954 | France . |
| 1461133 | 10/1966 | France . |
| 2086307 | 12/1971 | France . |
| 2135168 | 12/1972 | France . |
| 2290024 | 5/1976 | France . |
| 2428910 | 1/1980 | France . |
| 472112 | 4/1969 | Switzerland . |

*Primary Examiner*—Harold Broome

*Attorney, Agent, or Firm*—Spellman, Joel and Pelton

[57] ABSTRACT

The relay contains an excitation coil, a U-shaped yoke with one of its legs serving as the core of the coil, and an armature to operate at least one switching contact of a contact carrier unit. This unit contains a supporting bridge which extends essentially perpendicularly to the axis of the coil and which carries the contact finger(s) of the switching contact(s). The contact carrier unit is fastened to the free leg of the yoke. One edge of the face end of the free yoke leg serves as knife-edge bearing for the armature. The armature is fastened to the free yoke leg by a holding element. In order to make the relay compact and easy to assemble, the armature is angularly formed, thus having a magnetically active leg and a free leg. The free leg which does interact with the core of the coil extends essentially parallel to the free yoke leg. The contact fingers are positioned essentially parallel to the axis of the coil. The supporting bridge is provided with a fastening piece. By means of this piece, the contact carrier unit is fastened through a single screw on that part of the free yoke leg which is not covered by the free leg of the armature.

21 Claims, 9 Drawing Figures

RELAY

BACKGROUND OF THE INVENTION

1. Field of the Invention

This invention relates to a relay. In particular, this invention relates to a relay of the type having an excitation coil; a U-shaped yoke comprising a leg serving as the core of said excitation coil, a free leg, and a bridge connecting said legs; a contact carrier unit which is attached to said free leg of said yoke; a supporting bridge associated with said contact carrier unit and extending essentially perpendicularly to the axis of said excitation coil; at least one switching contact having contact fingers, said contact fingers being supported by said supporting bridge; an armature for operatin said switching contact, said armature having an armature leg for interacting with said core of said excitation coil, and a free armature leg not interacting with said core of said excitation coil; a knife-edge bearing for said armature, said knife-edge bearing formed by one edge of a face end of said free leg of said yoke; and a holding element for attaching said armature to said free leg of said yoke.

2. Description of the Prior Art

Such a relay is commercially available. This relay has an armature in the form of a plate which is placed perpendicularly to the axis of the excitation coil and perpendicularly to the free leg of the yoke. Two holding bolts serve as the holding element. They extend perpendicularly to the plane of the armature and penetrate the same. The holding bolts are pressed against the free leg of the yoke by a pressing plate and a screwing device. Operating fingers of said armature are located at that end which is positioned away from the core of the excitation coil. These fingers project beyond the free leg of the yoke. A large contact carrier unit surrounds the activating unit consisting of the excitation coil, of the yoke, and of an armature, on four sides. This activating unit is connected by two screws to the free leg of the yoke. The contact carrier unit contains a supporting bridge extending perpendicularly to the axis of the excitation coil. On this unit there are attached various plates made of an insulating material by two screw connections. The contact fingers of several switching contacts are inserted between the insulating plates. The contact fingers extend perpendicularly to the axis of the excitation coil. The contact fingers exceed significantly beyond the operating fingers of the armature. Therefore, this conventional relay requires considerable space. Furthermore, it is rather expensive to assemble this relay due to the multitude of screwing connections.

Another relay which is also commercially available has a cylindrical excitation coil with a cylindrical core. On one side, the core of the excitation coil reaches beyond the spool flange. It is riveted to a plate made of insulating material. The foot of an L-sahped yoke rests against the protruding end of the core of the excitation coil. It is clamped in between said one spool flange and the insulating plate. The yoke with its outer face end which faces away from the coil engages a shoulder of the insulating plate. The extension of this plate simultaneously serves as a contact carrier for three contact fingers of a switching contact which are placed one behind the other. At its end side, the free leg of the yoke contains a rectangular hole through which protrudes an angular armature. The free leg of the armature extends essentially parallel to the free leg of the yoke. A tension spring which is attached in the recess of the yoke serves as a holding element for the armature. The spring presses the armature against an edge of the face end of the free leg of the yoke. Thus, this edge serves as a knife-edge bearing. The free leg of the armature contains a centrally located recess so as to form two lateral armature operating fins which are connected to each other by a bridge made of insulating material. This bridge has a centrally located recess into which meshes a basically cross formed operating element. This element passes through an opening in the contact finger of an alternating contact. Together with the cross beam of the cross form, it engages the middle contact finger. In this relay an optimal guidance of the magnetic flux is not achieved, due to the air gap between the core of the excitation coil and the L-shaped yoke. Therefore, its control requires a substantial amount of power. This relay has a considerable height, because the spool unit of the excitation coil is supported by the contact carrier unit formed as an insulating plate.

SUMMARY OF THE INVENTION

Objects

It is an object of this invention to provide an improved relay.

It is another object of this invention to provide a relay of the type mentioned earlier which combines high compactness and easy assembly features with low requirements of control power.

Summary

According to this invention, the relay is characterized in that the armature is formed angularly; that the free leg of the armature extends essentially parallel to the free leg of the yoke, that the contact fingers of each switching contact are positioned approximately parallel to the axis of the excitation coil and are fastened with one end at said supporting bridge, and that the supporting bridge comprises a fastening piece, through which the contact carrier unit is attached to that part of the free leg of the yoke which is not covered by the free leg of the armature.

A considerable space saving in the construction of the relay has been accomplished by the angular design of the armature, by positioning the free leg of the armature approximately parallel to the free leg of the yoke, and by the arrangement of the contact fingers approximately parallel to the axis of the excitation coil. Aside from the compact design feature, an easy assembly of the relay is achieved by fastening the contact fingers in the supporting bridge and by the provision of the fastening piece through which the contact carrier unit is attached to that part of the free leg of the yoke which is not covered by the free leg of the armature. Furthermore, in comparison to the prior art relay described as the second example above, the one-piece design of the U-shape yoke results in a reduction of the air gaps in the magnetic circuit so that an improved conduction of the magnetic flow and thus a high armature operating force is achieved at a reduced control power.

It is of advantage if the contact carrier unit is fastened to the free leg of the yoke by a single screw. This facilitates both construction and assembly efforts.

According to another aspect of the invention, an actuating plate is provided. This plate is designed for establishing a mechanical operating link between the free leg of the armature and one contact finger of each switching contact. The actuating plate serves to obtain a good transmission of the armature operating force to the movable contact finger of each switching contact. An insulating material such as a palstic is well suitable as material for the actuating plate. The mechanical properties of such a material are fully sufficient to handle the operating forces. Also, satisfactory insulation between the contact finger and the armature can be achieved without any extra measures. Furthermore, the light weight of this material ensures quick operatings of the relay.

DETAILED DESCRIPTION OF THE PREFERRED EMBODIMENTS

Figure 1:
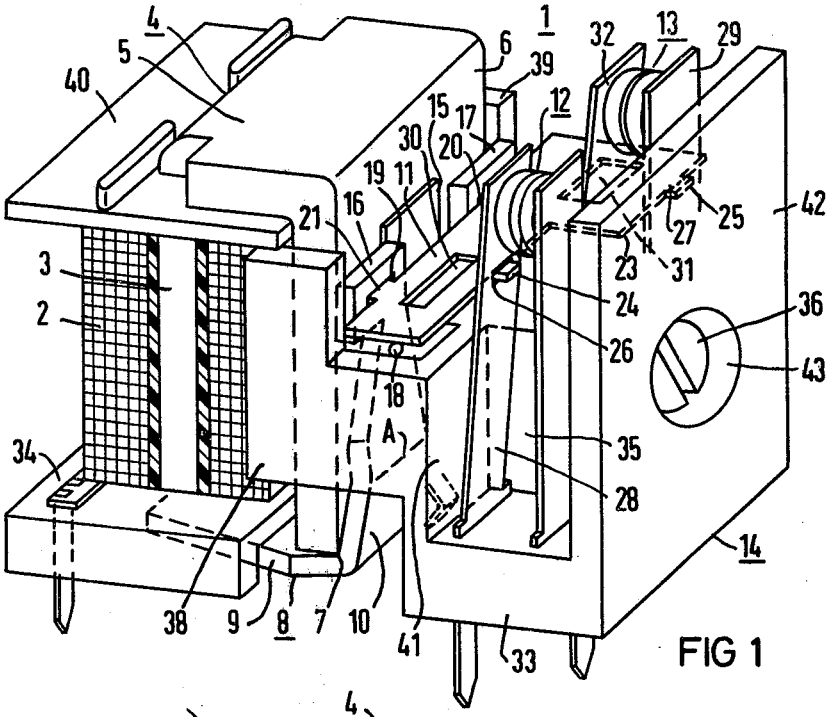
FIG. 1 is a perspective representation of a relay according to this invention.

In FIG. 1 a relay according to the invention is shown which has the reference numeral 1. The relay or excitation coil which may be rectangular or oval in its cross section is provided with the reference numberal 2. The excitation coil 2 sits on one leg 3 of a U-shaped magnetic return path member or yoke 4. The leg 3 of the yoke 4 serves as the core of the excitation coil 2. The leg 3 of the yoke 4 is connected by a cross piece or bridge 5 to a free leg 6 of the yoke 4. Both legs 3 and 6 of the yoke 4 are arranged essentially parallel to each other. In addition, the yoke 4 is formed such that all cross sections taken through its legs 3 and 4 in a vertical direction to the axis of the energizing coil 2 have the form of a small rectangle. Additionally, the bridge 5 as well as the free leg 6 of the yoke 4 are laterally broadened with respect to the leg 3 which dips into the excitation coil 2, in order to ensure a favoralbe conduction of the magnetic flux. The one-piece design of the yoke 4 serves the same purpose. Contrary to a multi-piece design, having core and yoke separated, this design prevents disturbing air gaps. The outer edge of the face end of the free leg 6 of the yoke 4 serves as a knife-edge bearing 7 for an angular armature 8.

A leg 9 of the armature 8 which extends from the knife-edge bearing 7 to the core 3 of the excitation coil 2 is tapered towards the core 3. The width of the leg 9 at its smaller end is essentially the same as the end face of the leg 3. Thus, the leg 9 has a trapezoidal form. At the location of the knife-edge bearing 7, the leg 9 of the armature 8 is designed just as wide as the free leg 6 of the yoke 4. This design contributes to an optimal conduction of the magnetic flux and ensures a small magnetic transition resistance where the knife-edge bearing 7 is located. The tapering of the leg 9 at the location of the core 3 results in a reduction of the mass of the armature 8 which has to be moved, and causes a significant reduction of the inertia. Cross sections taken parallel to the free leg 6 of the yoke 4 through the leg 9 have a rectangular form.

The angle between the leg 9 and the free leg 10 of the armature 8 is somewhat larger than 90° at the location of the knife-edge bearing 7. Above the knife-edge bearing 7, the free leg 10 of the armature 8 is slightly inclined along the line A towards the free leg 6. The leg 9 of the armature 8 is attracted when the excitation coil 2 is energized, so that the other leg 10 of the armature 8 moves away from the free leg 6 of the yoke 4. This movement of the free leg 10 is utilized by a control or actuating plate 11 to activate switching contacts or contacts 12 and 13 of a contact carrier structure 14.

The leg 10 of the armature 8 is arranged approximately parallel to the free leg 6 of the yoke 4. The free leg 10 has a central recess 15 which is open towards the upper end, as illustrated in FIG. 1. Thereby, two armature operating tongues or fins 16 and 17 are formed which are placed parallel to each other on either side of the recess 15. This design serves to decrease the mass of the armature 8. This design also enables the recess 15 to expose a part of the free leg 6 of the yoke 4 which part is utilized for fastening purposes as will be explained later.

Each of the armature activating fins 16 and 17 has an impression, dent or stamping at its end side. This stamping protrudes towards the free leg 6 of the yoke 4. In FIG. 1 only the stamping 18 of the armature operating fin 16 is visible. By means of these stampings, a defined, small spaced attachment of the free leg 10 of the armature 8 to the free leg 6 of the yoke 4 is achieved. At these spots, a relatively large magnetic resistance as well as a poor conductance of the magnetic flux will occur. Therefore, only a small breaking away force is required at these spots when the relay is in operation.

In FIG. 1 the armature operating fins 16 and 17 contain cavities or indentations 19 and 20 above the stampings 18. Into these indentations, protrusions 21 and 22 of the actuating plate 11 are introduced or meshed in a form-locking manner. The opposing edge 23 of the actuating plate 11 is also provided with protrusions 24 and 25. These protrusions 24 and 25 are introduced or meshed into corresponding form-adjusted apertures in the movable contact fingers 28 and 29 of the switching contacts 12 and 13, respectively. Thus, a satisfactory transfer of the armature operating force to the movable contact fingers 28 and 29 is ensured. At the same time a solid positioning of the actuating plate 11 is accomplished.

In the embodiment shown in FIG. 1, both switching contacts 12 and 13 are placed next to each other with respect to the free leg 8 of the yoke 4. Thus, the full width of the relay, which is determined primarily by the optimization of the magnetic flux, is utilized for a space saving placement of the switching contacts 12 and 13, and a significant construction depth of the relay 1 is also avoided. In the embodiment shown in FIG. 1, the switching contact 12 is designed as a closing contact, and the switching contact 13 is designed as an opening contact. However, it should be noted that for switching contacts 12 and 13 any desired dual combination of the three elements, namely closing contact, opening contact and alternating contact, may be employed.

The actuating plate 11 contains two rectangular apertures 30 and 31, each of which is placed between the movable contact finger 28 and 29, respectively, and the armature operating fin 16 and 17, respectively. In the case of the switching contact 13 which is designed as an opening contact, the immovable contact finger 32 (which is arranged oppositely to the contact finger 29 and forms the switching contact 13 therewith), projects through the aperture 31. The recesses 30 and 31 serve to extend the creepage path and thus increase the insulating quality of the actuating plate 11. This plate 11 may preferably be made of the insulating material "Pertinax".

The contact carrier structure 14 is provided with a supporting bridge 33. The four contact fingers of the switching contacts 12 and 13 are admitted or introduced into this bridge 33 approximately parallel to the axis of the excitation coil 2. The plane formed by the supporting bridge 33 extends vertically to the axis of the excitation coil 2. The cross dimensions of the supporting bridge 33, i.e. its dimensions in a direction vertical to the axis of the excitation coil 2 and parallel to the free leg 6 of the yoke 4, are identical to those of the energizing coil 2 in this direction. The supporting bridge 33 is approximately on the level of a flange 34 of the spool of the energizing coil 2. This flange 34 is turned away from the bridge 5 of the yoke 2.

The supporting bridge 33 is provided with a fastening element or piece 35 through which the contact carrier 14 is fastened at the free space between the two armature operation fins 16 and 17 of the free leg 6. Fastening is performed by screwing with a fastening screw 36. In the embodiment shown in FIG. 1, the fastening piece 36 is formed rectangularly. It is provided with a central boring hole for receiving the fastening screw 36. The rectangular fastening piece 35 is placed on the upper end of the supporting bridge 33 and protrudes beyond the supporting bridge 33 in the direction of the free leg 6 of the yoke. A holding element 37 (not referenced in FIG. 1) which is formed like a leaf spring and which is designed for holding the armature 8, is also located in the recess 15 between the two armature operating fins 16 and 17. The rectangular frontal area of the fastening piece 35 which is turned towards the free leg 6 presses at least one part of the holding element 37 against the free leg 6 of the yoke 4. The holding element 37 with at least one elastic holding arm pivotly keeps the armature 8 at the free leg 6 in its predetermined position with respect to the knife-edge bearing 7. The construction of the holding element 37 will be more fully described later with reference to FIG. 9.

At the sides of the supporting bridge 33 of the contact carrier structure 14, two supporting walls or arms 38 and 39 which are approximately parallel to each other, are provided. The arms 38 and 39 are positioned vertically with respect to the supporting bridge 33. They extend in the direction of the excitation coil 2. The two supporting arms 38 and 39 have such dimensions that they grip from below the other coil flange 40 of the coil 2 (which faces the bridge 5) and press it with little pressure against the bridge of the yoke 4, when the contact carrier structure 14 is in its screwed-on position. Thus, the screw fastening of the contact carrier 14 to the free leg 6 results in the possibility of securing the excitation coil 2 reliably and readily in its predetermined position. This represents a significant advantage over known relays which require additionally either some sort of screw fastening, riveting, or gluing in order to secure the excitation coil. It has already been mentioned that both supporting arms 38 and 39, in as much as their distance from each other is concerned, are placed such that the free leg 6 snugly fits between them. Thereby, freedom from twisting is achieved for the contact carrier 14. This kind of attachment also facilitates the assembly, because already prior to the insertion of the fastening screw 36, the contact carrier 14 may be attached to the free leg 6 in a clamping contact which is formed by the two supporting arms 38 and 39.

In the present relay, the supporting arms 38 and 39 depart vertically from a wall 41 of the contact carrier structure 14. This wall 41 extends vertically with respect to that face end of the carrying bridge 33 which is turned towards the free leg 6 of the yoke 4. This wall 41 merges into the fastening piece 35 and continues on the other side of the fastening piece 35 up to the end of the supporting bridge 33. The contact carrier 14 is designed symmetrically with respect to the symmetrical plane containing the axis of the fastening screw 36 and the axis of the excitation coil 2. The lateral supporting arms 38 and 39 may also originate directly from the supporting bridge 33.

That side of the supporting bridge 33 of the contact carrier unit 14 which is turned away from the free leg 6 of the yoke 4 proceeds into a back wall 42. This wall 42 extends parallel to the free leg 6. It contains a hole or indentation 43 to accommodate the fastening screw 36. The back wall 42 serves to protect the switching contacts 12 and 13 against damage which my be caused by mechanical actions or effects. Such effects would adversely affect the adjustment of the switching contacts 12 and 13. Furthermore, the supporting bridge 33, the wall 41 and the rectangular fastening piece 35 in conjunction with the back wall 42 form recesses or niches which surround the larger portion of the switching contacts 12 and 13 and which exhibit a high electrical track resistance against each other.

The entire contact carrier system 14 containing the supporting bridge 33, the fastening piece 35, the wall 41, the supporting arms 38 and 39 and the back wall 42 is designed in one piece and consists of a synthetic insulating material such as a plastic. From a technical manufacturing point of view, it is of advantage to produce the contact carrier system 14 by injection molding.

Figure 2:
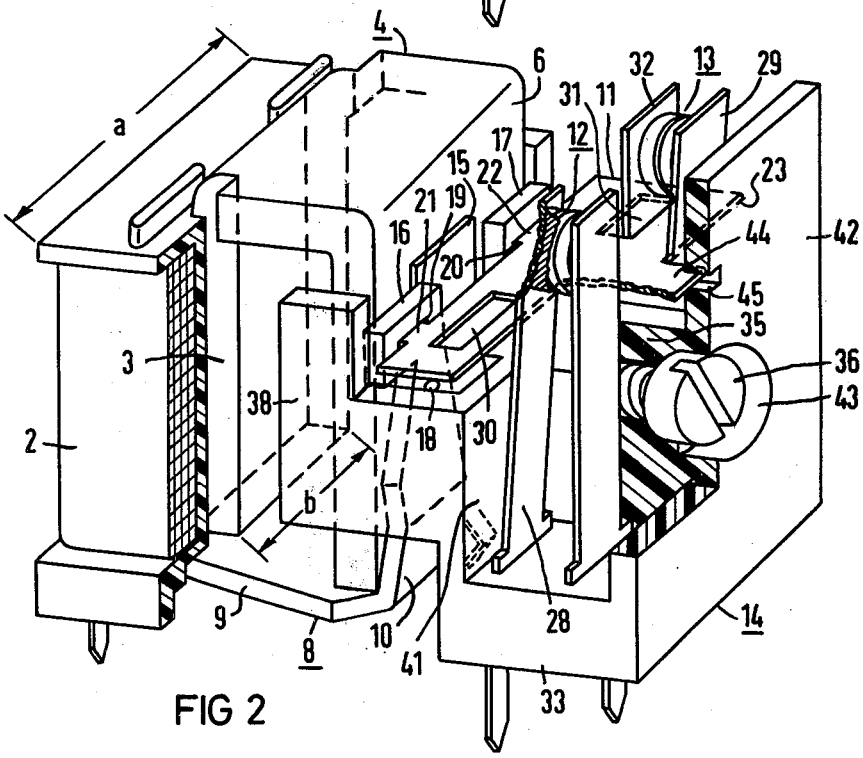
FIG. 2 is a perspective representation of another embodiment of a relay according to this invention having a modified actuating plate.

In FIG. 2, the perspective view of another embodiment of the relay according to the invention is illustrated. This relay represents an alternative design of the positioning of the actuating plate 11. Those elements of the relay which are identical with elements of FIG. 1 have been assigned the same reference numerals. For the sake of clarity, in FIG. 2 various elements contained in FIG. 1 are not shown or are shown only partially. Of the two supporting arms 38 and 39, only the supporting arm 38 is sketched in a schematic form.

As in the embodiment presented in FIG. 1, the actuating plate 11 is provided with protrusions 21 and 22 which are directed towards the free leg 6 of the yoke 4. These protrusions 21 and 22 are introduced or mesh into corresponding form adapted recesses 19 and 20 of the armature operating fins 16 and 17, respectively. The opposite edge 23 of the actuating plate 11, however, has only a single protrusion 44, which is located in the plane of the actuating plate 11. This protrusion 44 is introduced or meshed into a guiding recess 45 designed as a breakthrough in the back wall 42 of the contact carrier system 14. The protrusion 44 is positioned or supported in the recess 45, thereby being displaceable in a longitudinal direction. Thus, a satisfactory three point bearing or support of the actuating plate 11 is provided. This also eliminates the need to provide the edge 23 of the plate 11 with several protrusions and to provide recesses in the movable contact fingers 28 and 29. This simplifies the manufacture of the relay. It furthermore makes possible a simple sight control of the correct adjustment of the contact fingers. In the case of the switching contact 13, which is designed as an opening contact, it is necessary that the movable contact finger 29 has a distance of approximately one-tenth millimeter to the edge 23 of the plate 11. The consumption of the contacts while they are in operation must be compensated for by adjustment. In the relay of FIG. 2, this is possible under sight control.

Figure 3:
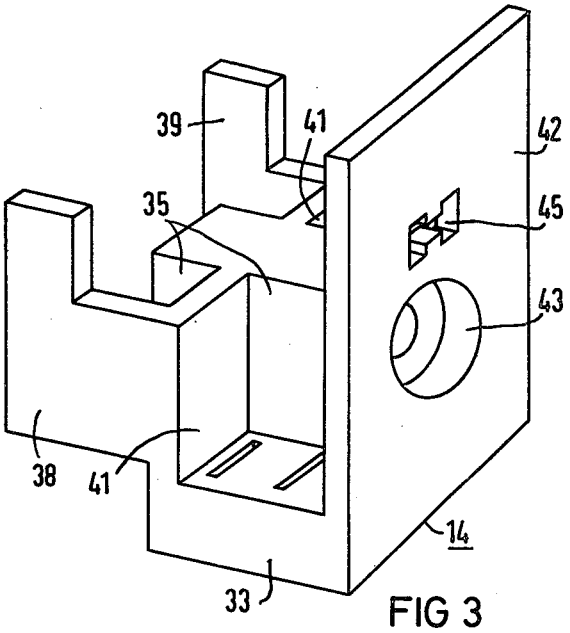
FIG. 3 is the contact carrier of the relay shown in FIG. 2 without switching contacts in a perspective representation.

FIG. 3 is a perspective view of the contact carrier unit 14 in a detailed representation. For greater clarity of the illustration, the switching contacts are not included in FIG. 3. The contact carrier 14 is constructed mirror symmetrically. The symmetrical plane contains the axis of the boring which adjoins the recess 43 and passes through the rectangular fastening element 35. The symmetrical plane extends vertically to the supporting bridge 33. The free end face of the fastening piece 35 which is arranged parallel to the back wall 42, presses the holding element 37 (see FIG. 9) against the free leg 6 of the yoke 4.

Extensive and long lasting empirical and theoretical investigations resulted in the conclusion that with a predetermined width a (see FIG. 2) of the excitation coil 2, the required driving or operating force for the switching contacts 12 and 13 can be generated with a very small control power, provided that the ratio of the width a of the excitation coil 2 to the width b (see FIG. 2) of the yoke leg 3 acting as a core, ranges between 1.65 and 2.0. The minimum driving force is required when the ratio a/b equals 1.75. A particularly favorable range is $a/b = 1.75 \pm 0.05$.

FIGS. 4 to 8 represent different embodiments of the actuating plate 11.

Figure 4:
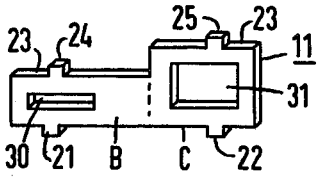
FIG. 4 is an embodiment of the actuating plate designed for one opening contact and one closing contact.

FIG. 4 illustrates the design of an actuating plate 11 described already in conjunction with FIG. 1. This plate 11 has a closing contact located on the left-hand side and an opening contact located on the right-hand side. The protrusions 21 and 22 are designed to mesh or fit into the fins 16 and 17, respectively, and the protrusions 24 and 25 are provided to fit or mesh into recesses in the movable contact fingers 28 and 29 of the switching contacts 12 and 13, respectively.

Figure 5:
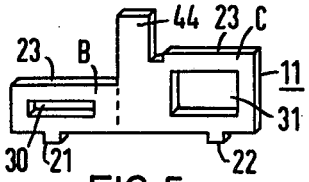
FIG. 5 is another embodiment of the actuating plate designed for one opening contact and one closing contact.

In FIG. 5 is illustrated the design of the actuating plate 11 as described in FIG. 2. Here the same mating of the switching contacts 12 and 13 is chosen, that is a closing contact and an opening contact, respectively. In place of the two projections 24 and 25 (see FIG. 4), in this embodiment only a single protrusion 44 is required, which fits or meshes into the guiding hole or recess 44 of the back wall 42.

Figure 6:
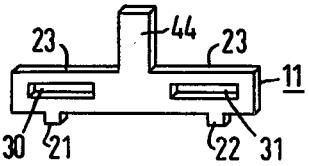
FIG. 6 is an embodiment of the actuating plate designed for closing contacts.

FIG. 6 demonstrates the design of an actuating plate 11 for two closing contacts for a three point support of the actuating plate 11, as explained in detail in connection with FIG. 2. In this embodiment, the rectangular holes 30 and 31 both have the same size, and the plate 11 is symmetrical with respect to the longitudinal axis along the protrusion 44.

Figure 7:
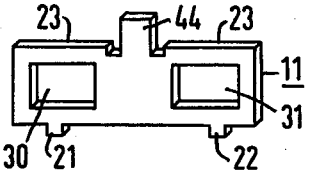
FIG. 7 is an embodiment of the actuating plate designed for opening contacts.

FIG. 7 shows a design of the actuating plate 11 for two opening contacts. Again, the design is symmetrical with respect to the protrusion. The rectangular holes 30, 31 are larger than those in FIG. 6.

Figure 8:
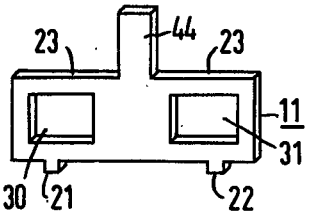
FIG. 8 is an embodiment of the actuating plate designed for alternating contacts.

In FIG. 8 is illustrated a design of the actuating plate 11 determined for two alternating contacts. This design is similar to that shown in FIG. 7. The major difference is an elongated protrusion 44.

All illustrated forms of the plate 11 are equivalent in that they represent a one-piece construction and that they are composed of two rectangular partial planes B and C. These partial planes B and C are in each case specifically adapted to the particular type of the switching contacts.

Figure 9:
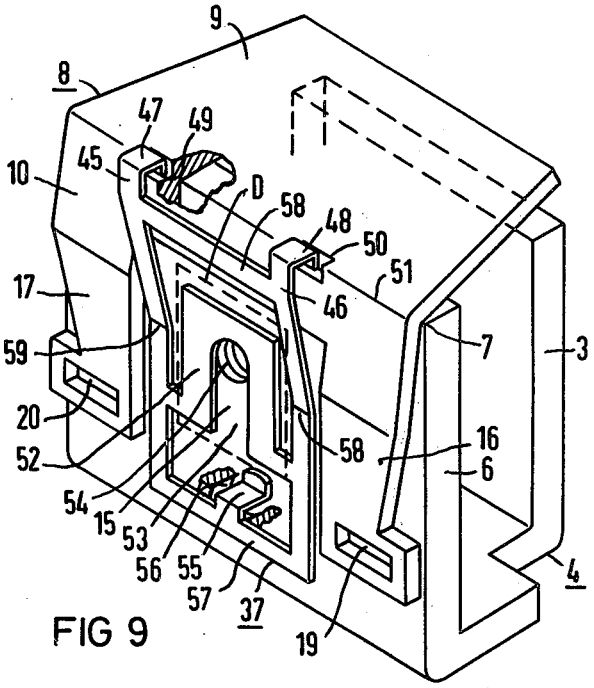
FIG. 9 is a representation of the leaf spring type holding element for the armature in the mounting position.

In FIG. 9 the holding element 37 for mounting the armature 8 on the knife-edge 7 of the yoke 4 is illustrated together with these elements. The holding element 37 is located in the recess 15 between the two armature operating fins 16 and 17 at the outer area of the free leg 6 of the yoke 4. The holding element 37 contains two elongated portions or holding arms 45 and 46 which are arranged essentially parallel to each other. Each of the holding arms 45 and 46 at its free end is bent to an angle of approximately 135° so as to form two parallel claws 47 and 48. Both claws 47 and 48 mesh or protrude into recesses 49 and 50 of the armature 8. These recesses 49 and 50 are arranged in the area of the bending zone 51 of the armature 8.

The holding arms 45 and 46 are connected to each other by a fastening bridge 52 which is nearly U-shaped and which includes a slit or slotted hole 53 that is open on one side. The U-shaped fastening bridge 52 represents a fastening area. Against the area of the square D drawn in dotted lines in the illustration and including the fastening bridge 52, the frontal end face of the fastening piece 35 of the contact carrier unit 14 is pressed. A taphole 54 located in the area of the slotted hole 53 in the free leg 6 serves to receive the fastening screw 36 of the contact carrier unit 14. The slotted hole 53 makes it possible to shift the holding element 37, thereby adjusting the proper tension load for the setting of the armature 8 on the knife-edge bearing 7.

At that one of its ends which is away from the claws 47 and 48, the holding element 37 contains a projection or holding nose 55 which engages a holding opening 56 in the free leg 6 of the yoke 4. Therefore, by attaching the holding element 37 during assembly, the armature 8 is already secured in a type of three point bearing prior to the application of the screwing mechanism (fastening screw 36).

The holding nose 55 projects from a link member or connection bridge 57. This bridge 57 connects the holding arms 45 and 46 at their far ends which are away from the claws 47 and 48. Prior to the final positioning and fastening of the holding element 37 by screwing, this connecting bridge 57 produces the major portion of the initially relatively low spring force for holding the armature 8, in combination with the spring effect of the claws 47 and 48. However, as soon as the contact carrier unit 14 is tightly screwed on and the holding element 37 is pressed against the free leg 6 in the area of the square D (illustrated in dotted form in FIG. 9), basically the increased holding force generated by the claws 47 and 48 of the holding element 37 is effective. This has the result that once the relay is fully assembled, the armature 8 is efficiently pressed against the knife-edge bearing 7, even in the event of a mechanical stress which may occur in the form of a shock. The process of screwing the contact carrier unit 14 tight thus results in a "changing over" of the elasticity constant of the holding element 37 effective for fastening the armature 8, to a higher value. In this process, the parts 55, 57 of the holding element 37 which initially determine the elasticity constant are subsequently inactivated.

The holding arms 45 and 46 are connected with each other directly behind the claws 47 and 48 by means of a connection member or supporting bridge 58. This bridge 58 mechanically stabilizes both holding arms 45 and 46.

The holding arms 45 and 46 are located up to their bending lines 59 and 60 in a common plane with the connecting bridge 57 and with the fastening bridge 52. Thus, in this area they rest on the outer plane or end face of the free leg 6. Starting from the bending lines 59 and 60 and up to the claws 47 and 48, the holding arms 45 and 46 are somewhat bent back with respect to the outer plane of the free leg 6. This bending back is performed such that a holding power is transferred to the armature 8 through claws 47 and 48. This holding power is transmitted via the knife-edge bearing 7. Thereby, the armature 8 is privotly attached to the knife-edge bearing 7, without having the fastening method put into effect by the holding element 37 cause a torque at the armature 8.

The holding element 37 is constructed mirror symmetrically. The summetrical plane extends parallel to the holding arms 45 and 46 through the middle line of the slotted hole 53. It is positioned vertically to the plane determined by the connecting bridge 57 and the fastening bridge 52.

While the forms of the relay herein described constitute preferred embodiments of the invention, it is to be understood that the invention is not limited to these precise forms of assembly and that a variety of changes may be made therein without departing from the scope of the invention.

What is claimed is:

1. A relay, comprising in combination:

an excitation coil having a core and at least one flange;

a U-shaped one-piece yoke comprising a covered yoke leg, a free yoke leg, and a bridge connecting said yoke legs with each other, said covered yoke leg serving as said core of said excitation coil;

a contact carrier unit;

a supporting bridge associated with said contact carrier unit and extending essentially perpendicularly to the axis of said excitation coil;

at least one switching contact having contact fingers, said contact fingers being positioned approximately parallel to the axis of said excitation coil and fastened with one end at said supporting bridge;

an angularly formed armature for operating said switching contact, said armature having an interacting armature leg for interacting with said core of said excitation coil, and a free armature leg not interacting with said core of said excitation coil, said interacting armature leg extending towards said core of said excitation coil, and said free armature leg extending essentially parallel to said free leg of said yoke and thereby covering a portion thereof, whereby said free armature leg is provided with a central recess, the end portion of said free armature leg thereby forming two armature operating fins;

a fastening piece associated with said supporting bridge, said fastening piece having an end face;

means for connecting said end face of said fastening piece to said free yoke leg at the location of said central recess provided between said fins in said free armature leg, thereby attaching said contact carrier unit to said yoke;

at least one supporting side arm provided on said contact carrier, said side arm extending from said contact carrier beyond said free yoke leg and supporting the inner face end of said flange of said excitation coil, whereby said flange supports with its outer face end said bridge connecting said two yoke legs;

a knife-edge bearing for supporting said armature, said knife-edge bearing being formed by one edge of a face end of said free yoke leg; and holding means for attaching said armature to said free leg of said yoke.

2. The relay according to claim 1, wherein said contact carrier unit is attached to said free leg of said yoke by means of a single screw.

3. The relay according to claim 1, further comprising an actuating plate for establishing a mechanical operating connection between said free leg of said armature and one contact finger of each switching contact.

4. The relay according to claim 3, wherein said actuating plate contains an aperture between one contact finger of at least one switching contact and said free leg of said armature.

5. The relay according to claim 1, wherein said contact carrier unit is provided with a back wall at that end of said supporting bridge which is turned away from said free leg of said yoke, said back wall extending in the direction of the axis of said excitation coil, whereby said supporting bridge and said back wall form an L-shaped structure.

6. The relay according to claim 1, further comprising:

an actuating plate having two protrusions on its one side and at least one further protrusion on its opposite side; and a back wall provided at one end of said supporting bridge, said back wall containing a guiding recess;

wherein said armature operating fins are provided with cavities, wherein said two protrusions on said one side of said actuating plate mesh into said cavities, and wherein said further protrusion of said actuating plate meshes into said guiding recess of said back wall.

7. The relay according to claim 6, wherein an actuating plate is provided, said plate having two protrusions on its one side and at least a further protrusion on its opposite side, wherein said armature operating fins are provided with cavities, wherein said two protrusions on said one side of said actuating plate mesh into said cavities, wherein at least one movable contact finger of a switching contact is provided with a further recess, and wherein said further protrusion of said actuating plate meshes into said further recess of said movable contact finger.

8. The relay according to claim 1, wherein said means for connecting is a screw, and wherein said fastening piece is connected to said free yoke leg by means of said screw.

9. The relay according to claim 8, wherein said fastening piece is formed as a parallelepiped block which has a central hole for receiving said screw.

10. The relay according to claim 1, wherein said fastening piece projects beyond said supporting bridge in the direction towards said free leg of said yoke.

11. The relay according to claim 1, wherein said holding element for said armature is formed as a leaf spring type element having at least one holding arm, wherein said holding element is fastened with at least one portion of its plane to said free leg of said yoke, and whereby said holding element with at least one elastic holding arm holds said armature in its position relative to said free leg of said yoke.

12. The relay according to claim 1, wherein said holding element has a fastening area which is pressed by said fastening piece of said contact carrier unit to said free yoke leg.

13. The relay according to claim 11, wherein said holding element is provided with two holding arms, said holding arms being bent at their ends such as to form claws, wherein recesses are provided in the area of a bent zone of said armature, wherein said claws mesh with said recesses, thereby pressing said armature to said knife-edge bearing at said free leg of said yoke.

14. The relay according to claim 12, wherein a holding nose projects from said holding element, wherein a holding opening is provided in said free leg of said yoke, and wherein said holding nose meshes into said holding opening.

15. The relay according to claim 1, wherein said contact carrier unit is provided with two switching contacts, each of which being arranged at one side of a reference plane that contains the axis of said excitation coil and that extends perpendicularly to said supporting bridge.

16. The relay according to claim 15, wherein any desired dual combination out of the three elements closing contact, opening contact and alternating contact is provided as switching contacts.

17. The relay according to claim 1, wherein a one-piece actuating plate is provided, said plate having two rectangular partial planes and containing at least one aperture, whereby a straight outer edge of one of said partial planes is provided for operating the movable contact finger of one of said switching contacts, whereby one of said switching contacts is an opening contact, and whereby the stationary contact finger of said opening contact protrudes contactlessly through said aperture in said actuating plate.

18. The relay according to claim 1, wherein said contact carrier unit comprises two supporting side arms which are arranged parallel to each other and which grasp said free yoke leg.

19. The relay according to claim 1, wherein said contact carrier unit consists at least partially of an insulating synthetic material and is designed as one piece.

20. The relay according to claim 3, wherein said actuating plate is made of "Pertinax".

21. The relay according to claim 1, wherein the ratio of the width of said excitation coil to the width of that leg of said yoke which serves as the core of said coil, is in the range from 1.65 to 2.0.

* * * * *